US008261716B2

(12) United States Patent
Bergbauer et al.

(10) Patent No.: US 8,261,716 B2
(45) Date of Patent: Sep. 11, 2012

(54) DEVICE FOR GENERATING A VACUUM IN A MOTOR VEHICLE

(75) Inventors: Dietmar Bergbauer, Obertshausen (DE); Oliver Kirmess, Riedstadt (DE); Bjorn Nordmann, Zornheim (DE); Helmut Oswald, Albig (DE); Uwe Steinmann, Ober-Ramstadt (DE)

(73) Assignee: GM Global Technology Operations LLC, Detroit, MI (US)

( * ) Notice: Subject to any disclaimer, the term of this patent is extended or adjusted under 35 U.S.C. 154(b) by 606 days.

(21) Appl. No.: 12/091,553

(22) PCT Filed: Jul. 1, 2006

(86) PCT No.: PCT/EP2006/006427
§ 371 (c)(1),
(2), (4) Date: Nov. 18, 2008

(87) PCT Pub. No.: WO2007/006441
PCT Pub. Date: Jan. 18, 2007

(65) Prior Publication Data

US 2009/0095253 A1 Apr. 16, 2009

(30) Foreign Application Priority Data

Jul. 7, 2005 (DE) ..... 10 2005 031 744

(51) Int. Cl.
*F01L 13/06* (2006.01)
*F02D 9/08* (2006.01)

(52) U.S. Cl. ..... 123/337; 123/320; 123/339.16; 123/389; 417/159

(58) Field of Classification Search ..... 123/320, 123/336, 337, 339.16, 389; 417/159
See application file for complete search history.

(56) References Cited

U.S. PATENT DOCUMENTS 4,211,200 A * 7/1980 Rocchio et al. ..... 123/339.13
4,899,708 A * 2/1990 Jung ..... 123/337
6,321,716 B1 * 11/2001 Mashiki et al. ..... 123/295
(Continued)

FOREIGN PATENT DOCUMENTS

DE 2406182 A1 8/1974
(Continued)

*Primary Examiner* — Erick Solis
(74) *Attorney, Agent, or Firm* — Ingrassia Fisher & Lorenz, P.C.

(57) ABSTRACT

A device is provided for producing and/or augmenting a partial vacuum in a motor vehicle, in particular for operating a partial vacuum brake servo-unit. The device includes, but is not limited to a throttle unit, which has at least one throttle valve housing and a throttle valve which is arranged so as to be rotatable in an angle range in a throttle channel in the throttle valve housing for controlling a fluid flow in the throttle channel. The device also includes, but is not limited to means for producing and/or augmenting partial vacuum, the means being configured as partial vacuum augmentation means integrated into the throttle valve housing, which partial vacuum augmentation means act according to Bernoulli's principle in the manner of a sucking jet pump to produce an augmented partial vacuum for at least one brake servo-unit. The means are configured as at least one control bore extending through the throttle valve housing, wherein the control bore opens in the throttle channel in an opening to produce a partial vacuum in the control bore and the control bore is set in the drag direction at a setting angle $\alpha>0°$ measured with respect to the cross-sectional plane of the throttle channel.

7 Claims, 3 Drawing Sheets

U.S. PATENT DOCUMENTS

| | | | | |
|---|---|---|---|---|
| 6,951,199 | B2 * | 10/2005 | Suzuki | 123/339.11 |
| 7,353,812 | B1 * | 4/2008 | Gosdzinski et al. | 123/585 |
| 7,610,140 | B2 * | 10/2009 | Hirooka | 701/103 |
| 2002/0174851 | A1 | 11/2002 | Elliot et al. | |
| 2003/0019473 | A1 * | 1/2003 | Wild et al. | 123/389 |
| 2006/0060175 | A1 | 3/2006 | Sonoda et al. | |

FOREIGN PATENT DOCUMENTS

| | | | |
|---|---|---|---|
| DE | 2717685 | A1 | 10/1978 |
| DE | 3238882 | | 4/1984 |
| DE | 4202393 | | 8/1993 |
| DE | 19503568 | A1 | 8/1996 |
| DE | 19612230 | | 10/1997 |
| DE | 19622378 | | 12/1997 |
| DE | 19808548 | | 9/1999 |
| DE | 19961611 | A1 | 7/2001 |
| DE | 10144670 | C1 | 5/2003 |
| DE | 10320857 | | 11/2004 |
| DE | 10321090 | A1 | 12/2004 |
| EP | 1347162 | A1 | 9/2003 |
| FR | 834168 | A | 11/1938 |
| GB | 1462354 | A | 1/1977 |

* cited by examiner

DEVICE FOR GENERATING A VACUUM IN A MOTOR VEHICLE

CROSS-REFERENCE TO RELATED APPLICATIONS

This application is a U.S. National-Stage entry under 35 U.S.C. §371 based on International Application No. PCT/EP2006/006427, filed Jul. 1, 2006, which was published under PCT Article 21(2) and which claims priority to German Application No. 102005031744.8, filed Jul. 7, 2005, which are all hereby incorporated in their entirety by reference.

TECHNICAL FIELD

The invention relates to a device for producing and/or augmenting a partial vacuum in a motor vehicle, in particular for operating a partial vacuum brake servo-unit, comprising a throttle unit, which has at least a throttle valve housing and a throttle valve which is arranged so as to be rotatable in an angle range in a throttle channel in the throttle valve housing for controlling a fluid flow in the throttle channel, the device also comprising means for producing and/or augmenting a partial vacuum, the means being configured as partial vacuum augmentation means integrated into the throttle valve housing, which partial vacuum augmentation means act according to Bernoulli's principle of a sucking jet pump to produce an augmented partial vacuum for at least one brake servo-unit.

BACKGROUND

A device for producing a partial vacuum in a motor vehicle with an internal-combustion engine already has many uses. The provision of the partial vacuum in most vehicles is necessary, in particular for the functioning of brake servo-units supplied with partial vacuum. In these, the difference between the atmospheric pressure and the partial vacuum is exploited to increase the braking force on the brake cylinder. Safe operation of the brake servo-unit and therefore the brake system of the motor vehicle therefore always requires that an adequate partial vacuum be maintained in the vacuum chamber of the brake servo-unit by means of a non-return valve to ensure adequate braking force in every driving situation. The quantity control member for the power control of the internal-combustion engine generally controls the intake air flow and therefore the power of the internal-combustion engine by means of a rotary adjustment of a throttle valve. The disadvantage in this principle in relation to the possibility of tapping off a partial vacuum is the partial vacuum in the intake manifold which is different at a different power setting of the internal-combustion engine and dependent on the driving situation. Especially in the case of vehicles with comfort equipment such as an automatic transmission and a powerful air-conditioning system, the inlet pipe partial vacuum is not sufficient, in some circumstances, in conjunction with a spark ignition engine which has been optimised with regard to the part load throttle losses, to reliably supply the brake system. Stop-and-go driving situations on a downhill slope with high ambient temperatures have to be taken into account here, in particular.

An intake air sucking jet pump is occasionally provided parallel to the throttle valve connection piece to improve the partial vacuum level. By exploiting the corresponding part of the intake air flow as a propellant, an increased partial vacuum can be produced in a Venturi tube according to Bernoulli's law as a result of the generally known principle of cross-sectional constriction and the increase in speed connected therewith.

To provide the partial vacuum, electrically or mechanically driven partial vacuum pumps have already also been proposed, which, however, have a poor overall degree of efficiency because of the multiple energy conversion in the motor vehicle with an internal-combustion engine. In addition, the partial vacuum pumps used as auxiliary units give rise to considerable parts costs and lead to a higher susceptibility to faults of the overall system. The operating liability of a pneumatic brake servo-unit is therefore adversely affected and this is an important safety risk when operating the motor vehicle.

A device for producing and/or augmenting the partial vacuum in a pneumatic brake servo-unit for the brake system of a motor vehicle driven by an internal-combustion engine by means of a sucking jet pump is proposed in DE 198 08 548 A1, in which the sucking jet pump is arranged in the exhaust system of the internal-combustion engine and is used as a propellant for the exhaust gas mass flow of the internal-combustion engine. The disadvantage in this arrangement is the position of the device in the hot exhaust gas of the internal combustion engine which severely limits the possibilities for using various thermally unstable materials. In addition, the exhaust gas mass flow is proportionally dependent on the throttle valve position and engine speed so when the throttle valve is closed and there is therefore a small charge air flow, the exhaust gas mass flow also does not produce an adequate flow in every operating situation of the motor vehicle to ensure adequate partial vacuum to operate the pneumatic brake servo-unit.

DE 195 03 568 A1 relates to a quantity-controlled internal-combustion engine with a sucking jet pump arranged in a bypass to the quantity control member or throttle valve for the partial vacuum production of a servo motor, in particular of a brake servo-unit, wherein a shut-off valve and/or throttle valve provided in the bypass upstream from the sucking jet pump is arranged. Although adequate production of a partial vacuum is possible with this structure even with a small fluid flow of the charge air, the arrangement has an external structure which is arranged next to the quantity control member acting as a throttle unit, and has further individual parts which have to be integrated in the engine compartment. In addition, a shut-off valve and/or throttle valve is required which disadvantageously has to be electrically activated.

A throttle valve connection piece for an internal combustion engine of a motor vehicle with a throttle valve which can be adjusted in a channel is proposed in DE 196 22 378 A1, in which the region of the channel with a throttle valve is bridged by a bypass channel. Viewed in the flow direction, an electrically switchable valve is firstly arranged in the bypass channel followed by a Venturi tube. A partial vacuum mechanism for a brake servo-unit is connected in the entry region of the Venturi tube. This arrangement also requires, externally to the throttle valve connection piece, a structure which has to be integrated in the engine compartment. In addition, because of the varying fluid flow in the channel, a valve is required which has to be controlled by an actuating element.

The problem occurs in these known methods that external inlet pipe arrangements are necessary that have to be integrated in the engine compartment, these, electrically or mechanically, having valves, which require electrical control and, in addition, are expensive and lead to increases susceptibility of the system to faults.

A device is known from FR 834 168 A, in which external arrangements and electrical controls are not necessary to produce a partial vacuum. The disadvantage here is, however, that an assured production of partial vacuum and in particular an improvement in partial vacuum is not possible, which is very important when operating partial vacuum brake servo-units, in particular.

It is therefore at least one object of the present invention to provide a device for producing and/or augmenting a partial vacuum in a motor vehicle by means of which for every idling or overrun operating point of the vehicle or the internal-combustion engine, the partial vacuum is improved within the laws relating to flow, so partial vacuum brake servo-units can be operated in such a way that an increased braking force assistance is available at all times. In addition, other object, desirable features and characteristics of the present invention will become apparent from the subsequent summary, detailed description, and the appended claims, taken in conjunction with the accompanying drawings and this background.

SUMMARY

The foregoing object and other objects, desirable features and characteristics are achieved from a device for producing a partial vacuum including, but not limited to a throttle unit having at least one throttle valve housing, a throttle valve (5) arranged so as to be rotatable in an angle range in a throttle channel in the throttle valve housing for controlling a fluid flow in the throttle channel. The device also includes, but is not limited to means for producing and/or augmenting a partial vacuum, the means being configured as partial vacuum augmentation means integrated into the throttle valve housing, which partial vacuum augmentation means act according to Bernoulli's principle in the manner of a sucking jet pump to produce augmented partial vacuum for at least one brake servo-unit.

An exemplary embodiment of the invention includes the technical teaching that the means are configured as at least one control bore extending through the throttle valve housing, wherein the control bore opens in the throttle channel in an opening to produce a partial vacuum in the control bore and the control bore is set in the drag direction at a setting angle $\alpha>0°$ measured with respect to the cross-sectional plane of the throttle channel, or, in that the means for producing and/or augmenting a partial vacuum are configured as at least one throttle bore arranged as a bypass to the throttle channel and in the throttle valve housing and extending in the flow direction, in order to produce an accelerated fluid flow in the throttle bore.

This solution offers the advantage that the means, because of the integration into the throttle valve housing, do not appear as individual parts, and do not therefore have to be separately integrated in the engine compartment. There is no need to provide partial vacuum production or augmentation mechanisms which are driven electrically or by a mechanical coupling to the internal-combustion engine. The partial vacuum is tapped off directly at the flow geometry which is integrated in the housing of the throttle valve and exploits the working principle of a sucking jet pump. A throttle unit is present in any case in internal-combustion engines which are controlled by the quantity principle (such as the spark ignition engine, for example). The partial vacuum can be improved within the laws relating to flow for any idling or overrun operating point of the vehicle or the internal-combustion engine owing to the mechanical configuration of the means for producing and/or augmenting the partial vacuum in order to, in particular, operate a pneumatically operated partial vacuum brake servo-unit in such a way that an increased braking power assistance is available at all times. The partial vacuum connection takes place at the housing of the throttle unit, only one hose or tube connection to a non-return valve, which is easily connected to the partial vacuum connection, being necessary for the partial vacuum supply of the brake servo-unit. This connection may either be present in addition to the existing partial vacuum supply or the conventional partial vacuum supply at the inlet pipe may be completely dispensed with if adequately large flow cross-sections can be demonstrated. In this case, no additional component is necessary. Furthermore, an electrical control of the partial vacuum production or augmentation means is dispensed with. The overall system of partial vacuum production can therefore finally be characterised in that the partial vacuum is exclusively produced by way of the control bore in the throttle valve housing and other partial vacuum supplies are dispensed with.

The means are configured according to a first embodiment as at least one control bore extending through the throttle valve housing, the control bore opening in the throttle channel in an opening to produce a partial vacuum in the control bore. The arrangement of the control bore is suitably inclined here at an angle relative to the flow direction. The angle $\alpha$ has to have a value here of greater than 0° to avoid a back-up effect.

According to a further embodiment of the invention, the means for producing and/or augmenting a partial vacuum are configured as at least one throttle bore arranged as a bypass to the throttle channel and in the throttle valve housing to produce an accelerated fluid flow in the throttle bore. Thus, the flow of the intake air used as a propellant is guided through a separate throttle bore, the throttle channel and the throttle bore running in parallel at least on a part length of the throttle valve housing. According to this embodiment, a separate sucking jet pump arrangement is present in modified form, this being integrated according to the invention in the throttle valve housing.

The means for producing and/or augmenting a partial vacuum are preferably configured as throttle valve angle range-dependent partial vacuum augmentation means to produce an increased partial vacuum in a specific region of the throttle valve opening. The means for partial vacuum production are such that the partial vacuum is tapped off in this throttle valve angle range in the zone of the highest flow speed.

Advantageously, this control bore opens in the half of the throttle channel situated downstream in the through-flow direction. This has the advantage that the normal inlet pipe partial vacuum is present during idling without additional loads with minimal valve opening. Accordingly, under some circumstances, the previous suction pipe partial vacuum connection of the brake servo-unit can be replaced by the connection to the control bore. Optionally, it may be investigated at what point on the peripheral valve line the opening is to be positioned (directly next to the valve axis or further removed from the axis, offset by 90° in an extreme case) in order to extend the brake partial vacuum increase over a larger angle range of the throttle valve opening. The design criteria here are, firstly, the maximally possible flow speed (corresponds to the maximum partial vacuum increase) and, secondly, the throttle valve angle range, over which the partial vacuum increase can be used. Operation of the engine close to idling can be assumed to be speeds of about 800 rpm to 1,000 rpm. Further measures for using the maximum flow speed may be seen in extending the control bore in a control tube projecting into the throttle channel and/or in structures in the throttle valve connection piece which extend into the flow cross-section with the free end of the control tube or bore opening in the region of the maximum flow speed.

The control bore preferably opens into the throttle channel in a region which can be at least partially passed over by the throttle valve.

A further measure improving the invention provides that the throttle valve has a thickening on the control bore side to achieve an increase in the partial vacuum by means of an increased valve opening angle range. The throttle valve, in a known manner, has a disc shape, the disc having a thickening on one half on the side of the control bore, which thickening can in turn bring about a constriction of the flow and therefore a reduction in the static pressure in the relevant range.

Regardless of the configuration of the throttle channel, the throttle bore has a flow constriction in the manner of a Venturi tube to accelerate the fluid flow in the throttle bore. Thus, the control bore may open into the throttle bore in the region of the flow constriction to produce a further increase in the partial vacuum therein.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background or the following detailed description.

Figure 1:
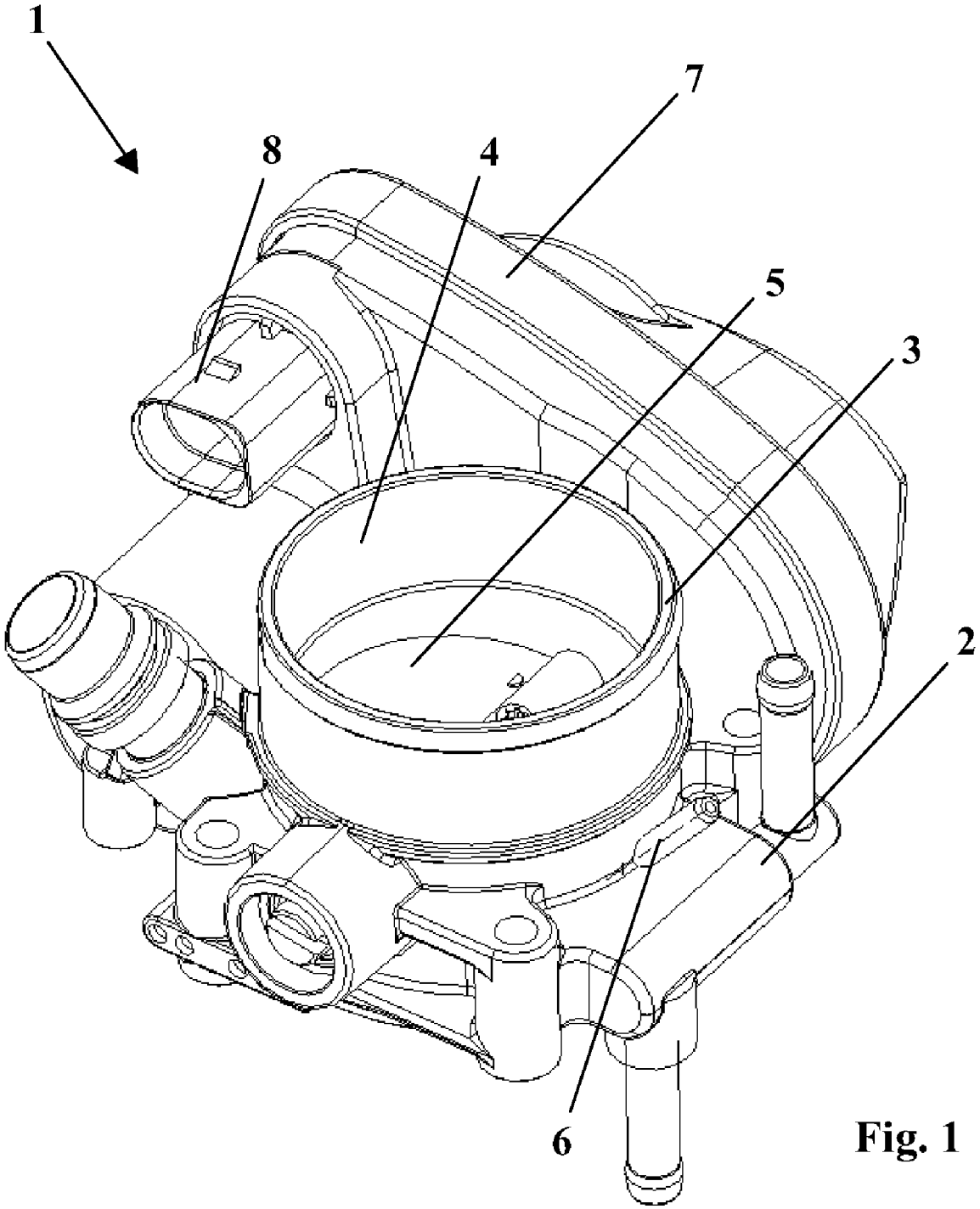
FIG. 1 shows a perspective view of a device for producing and/or increasing partial vacuum with a throttle unit.

The device shown in FIG. 1 comprises a throttle unit 2 having a throttle valve housing 3, through which a throttle channel 4 extends. The throttle unit 2 is arranged in the intake air line of the internal-combustion engine, not shown in more detail, the throttle channel 4 forming a connection between the hose or tube connection of the air filter and the intake air plenum of the internal-combustion engine. Rotatably arranged in the throttle channel 4 is a throttle valve 5, by means of which, with a rotation, the air mass flow of the intake air can be changed. The throttle valve 5 is in a substantially closed position in the embodiment shown, so the air mass flow of the intake air adopts a low value. The throttle valve housing 3 is designed in one part, connection pieces, fastening regions, assembly openings and the like being moulded on the throttle valve housing 3 here in addition to further components. A control bore 6 extends through the throttle valve housing 3 and opens, on the one hand, in the throttle channel 4 and, on the other hand, passes into a tubular portion, to which a partial vacuum hose can be connected. This partial vacuum hose, not shown in more detail, forms a connection between the means arranged in the throttle valve housing for producing partial vacuum and a pneumatic brake servo-unit or further functional units representing a partial vacuum consumer. Arranged on the rear part of the throttle valve housing is an electromechanical controller 7 which in particular controls the throttle valve 5. The controller 7 is electrically connected by means of a contact means 8, which allows an electrical connection to the central control electrics of the motor vehicle.

Figure 2:
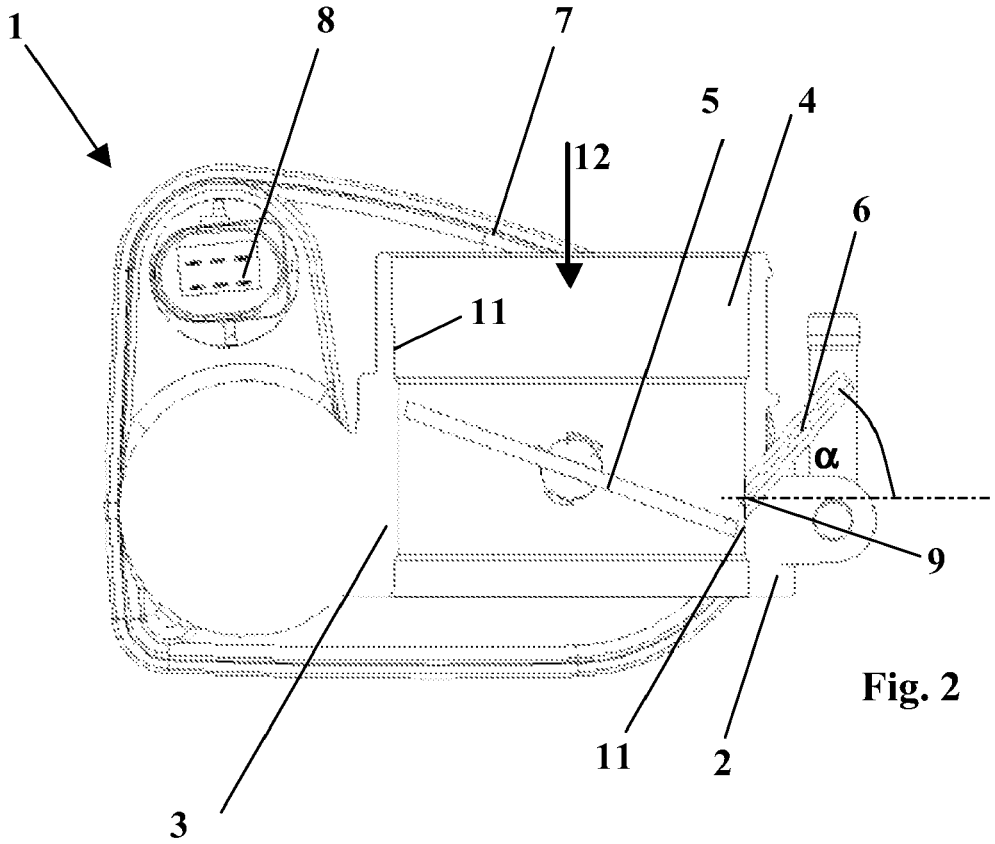
FIG. 2 shows a sectional view of the throttle unit, the control bore opening into the throttle channel.

FIG. 2 shows a sectional view of a first embodiment of the device 1, comprising a throttle unit 2, the control bore 6 opening into the control channel 4. The opening 9 is arranged directly in the region in which the throttle valve 5, during idling, adjoins the throttle valve wall 11. The flow constriction increases the flow speed of the air mass flow of the intake air, so that, according to the principle of Bernoulli, the static pressure is reduced, so that a partial vacuum is produced which continues in the control bore 6. So that the air mass flow moved in the flow direction 12 does not press into the control bore 6, the latter is set in the drag direction at a setting angle $\alpha>0°$ measured with respect to the cross-sectional plane of the throttle channel 4.

Figure 3:
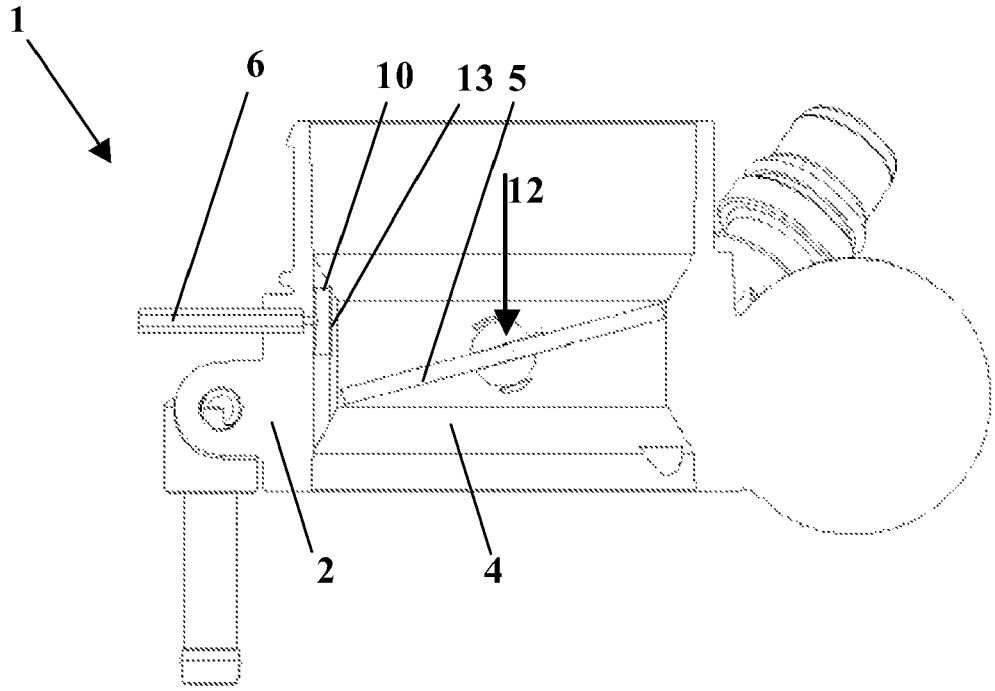
FIG. 3 shows a sectional view of the throttle unit, the latter having a throttle bore and the control bore opening into the throttle bore.

FIG. 3 reproduces a further embodiment of the device 1, which is shown in a sectional view through the throttle unit 2, the latter having a control bore 6 opening into a throttle bore 10. The throttle bore 10 is arranged in the throttle channel 4 and extends in the flow direction 12 so part of the intake air is branched off from the throttle channel 4 and flows through the throttle bore 10. The throttle bore 10 has a flow constriction 13 in the manner of a Venturi tube, so an acceleration of the intake air flow in the flow constriction 13 can be achieved by the throttle valve when there is a sub-critical pressure ratio. The control bore 6 opens in the region of the flow constriction 13 in the throttle bore 10, so an augmented suction effect can also be exploited here. When the throttle valve 5 is closed or almost closed, the air mass flow through the throttle channel is minimised and the throttle bore 10 acts as a bypass, in which an increased flow speed prevails and, in comparison to the inlet pipe partial vacuum, an increased partial vacuum can be tapped off by way of the control bore 6.

Figure 4:
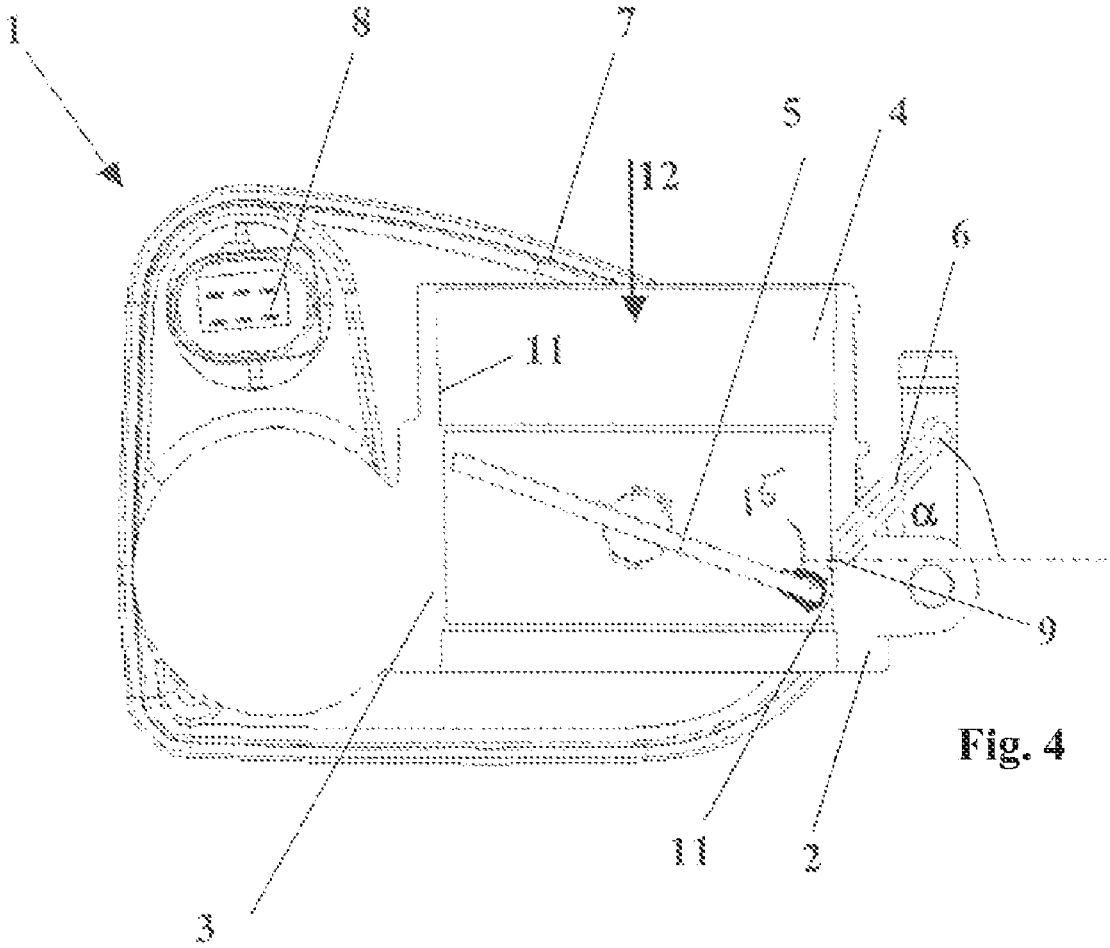
FIG. 4 shows the sectional of the throttle unit with the throttle valve having a thickening on the control bore side.

FIG. 4 shows an additional embodiment of the device 1, comprising the throttle unit 2 and the control bore 6 opening into the control channel 4. The opening 9 is arranged directly in the region in which the throttle valve 5, during idling, adjoins the throttle valve wall 11. The flow constriction increases the flow speed of the air mass flow of the intake air, so that, according to the principle of Bernoulli, the static pressure is reduced, so that the partial vacuum is produced which continues in the control bore 6. In this exemplary embodiment the throttle valve 5 has a thickening 15 on the control bore side, which achieves an increase in the partial vacuum by means of an increased valve opening angle range.

With regard to its design, the invention is not limited to the embodiments given above. A plurality of variants is conceivable, making use of the solution shown even with basically different types of designs. While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

The invention claimed is:

1. A device for producing a partial vacuum in a motor vehicle, comprising:

a throttle unit, which has at least one throttle valve housing;

a throttle valve configured to be rotatable in an angle range in a throttle channel in the throttle valve housing, the throttle valve configured to control a fluid flow in the throttle channel;

a control bore extending through the throttle valve housing and creating an opening into the throttle valve channel at a point where the throttle valve adjoins a throttle valve wall, wherein the control bore is set in the drag direction at a setting angle ($\alpha$) that is greater than zero degrees measured with respect to a cross sectional plane of the throttle valve channel.

2. The device according to claim 1, wherein the control bore opens into the throttle channel in the region in which the fluid flowing through the throttle channel has a maximum throughflow speed when the engine is operating close to idling with additional loads.

3. The device according to claim 2, wherein the control bore opens into the throttle channel in the half of the throttle channel situated downstream in the through-flow direction.

4. The device according to any one of claim 1, wherein the control bore opens into the throttle channel in a region which can be passed over by the throttle valve, at least partially, by the angle range of the throttle valve rotation.

5. The device according to claim 1, wherein the throttle valve has a thickening on the control bore side to achieve an increase in the partial vacuum by an increased valve opening angle range.

6. The device according to claim 1, wherein the throttle bore has a flow constriction in the manner of a Venturi tube to accelerate the fluid flow in the flow constriction.

7. The device according to claim 1, wherein the control bore opens into the throttle bore in the region of the flow constriction in order to produce a partial vacuum therein.

* * * * *